US005562046A

United States Patent [19]

Fetterman et al.

[11] Patent Number: 5,562,046

[45] Date of Patent: Oct. 8, 1996

[54] LOAD BEARING CROSSBEARER CONNECTION

[75] Inventors: D. Bruce Fetterman, Arlington; Stephen W. Smith, Dallas, both of Tex.

[73] Assignee: Trinity Industries, Inc., Dallas, Tex.

[21] Appl. No.: 298,563

[22] Filed: Aug. 30, 1994

[51] Int. Cl.[6] ..... B61D 17/04

[52] U.S. Cl. ..... 105/419; 105/396; 105/404; 105/418; 296/29

[58] Field of Search ..... 105/396, 397, 105/401, 404, 409, 413, 414, 415, 418, 419; 296/187, 203, 204, 205, 209, 29, 30

[56] References Cited

U.S. PATENT DOCUMENTS

| | | | |
|---|---|---|---|
| 2,255,900 | 9/1941 | Schlesinger | 105/411 |
| 2,652,006 | 9/1953 | Simonson | 105/419 |
| 3,319,583 | 5/1967 | Gutridge | 105/366 |
| 4,452,147 | 6/1984 | Jwuc | 105/4 A |
| 4,524,699 | 1/1985 | Pavlick | 105/4 R |
| 4,563,957 | 1/1986 | Billingsley et al. | 105/418 |
| 4,686,907 | 8/1987 | Woollam et al. | 105/4.1 |
| 4,771,706 | 9/1988 | Lindauer et al. | 105/415 |
| 4,782,762 | 11/1988 | Johnstone et al. | 137/355 |
| 4,805,539 | 2/1989 | Ferris et al. | 105/355 |
| 4,807,722 | 2/1989 | Jamrozy et al. | 105/355 |
| 4,862,810 | 9/1989 | Jamrozy et al. | 105/355 |
| 4,876,968 | 10/1989 | Lindauer et al. | 105/415 |
| 4,889,055 | 12/1989 | Jamrozy et al. | 105/355 |
| 4,893,567 | 1/1990 | Hill et al. | 105/419 |
| 4,909,157 | 3/1990 | Jamrozy et al. | 105/406.1 |
| 4,949,646 | 8/1990 | Jamrozy et al. | 105/406.1 |
| 5,001,990 | 3/1991 | Pavlick | 105/375 |
| 5,054,403 | 10/1991 | Hill et al. | 105/419 |
| 5,085,152 | 2/1992 | Tylisz et al. | 105/419 |
| 5,170,718 | 12/1992 | Hill et al. | 105/404 |
| 5,279,230 | 1/1994 | Thomas et al. | 105/355 |

*Primary Examiner*—S. Joseph Morano
*Attorney, Agent, or Firm*—Baker & Botts, L.L.P.

[57] ABSTRACT

A crossbearer connection (32) and method of forming a crossbearer connection (32) are disclosed, including a support bracket (34) angled to rest against an interior surface of a vertical and horizontal flange (54, 56) of the side sill (20) of a railway car (12), a projecting member (70) formed integral to the support bracket (34) having a male portion (78) and female portion (80), and where in the projecting member (70) extends through an opening (72) in the side wall (28), an exterior support member (76) having a base portion (90) and a male portion (98) which is sized to mate with the female portion (80) of the projecting member (70) and with the base (90) portion disposed against a portion of the exterior surface of the vertical flange of the side sill (20), and the male portion (78) of the projecting member (70) mating with a portion of the side stake (30) of the railway car (12), and a plurality of fasteners (106–120) for securing the support bracket (34) to the side sill (20) and the exterior support member (90) to the side sill (20).

20 Claims, 4 Drawing Sheets

LOAD BEARING CROSSBEARER CONNECTION

TECHNICAL FIELD OF THE INVENTION

This invention relates in general to the field of railway cars, and more particularly, to load bearing crossbearer connections on railway cars.

BACKGROUND OF THE INVENTION

In railway cars having side sills and crossbearers for carrying loads, the crossbearers are typically connected to the side sills for support. One example of connecting a crossbearer to a side sill is shown in U.S. Pat. No. 5,085,152 to Tylisz et al., assigned to Trinity Industries, Inc., which is incorporated herein for all purposes.

In designing various types of railway cars having side sills, it is frequently desirable to place the side sills as low as possible to the railway tracks or the prescribed clearance distance that has been authorized. At the same time, it is frequently desirable to maintain the strength and stability of the connection as well as ease of making the connection. Conventional crossbearer connections may not have provided an easy means for connecting the crossbearer to the side sill and side stakes that allow the side sills to be as low as desired while having a direct connection to the side stake.

SUMMARY OF THE INVENTION

Therefore, a need has arisen for an apparatus and method for conveniently attaching a crossbearer to a side sill of a railway car having side stakes that allows for direct connection to the side stakes and allows for a minimal distance between the rails and the bottom of the side sills. In accordance with the present invention, a method and apparatus for connecting a crossbearer to a side sill are provided that substantially eliminate or reduce the disadvantages and problems associated with the previously developed connections and methods.

According to an aspect of the present invention, a load bearing crossbearer connection for connecting a load bearing crossbearer to a portion of a side sill having a vertical flange and a horizontal flange and to a side stake of a railroad car is disclosed that includes a support bracket formed to rest against an interior surface of the vertical and horizontal flanges of the side sill. The connection may include a projecting member attached to or formed integral to the support bracket having a male portion and a female portion and with the projecting member extending through an opening in the side stake. The crossbearer connection may also include an exterior support member having a base portion and male portion which is sized to mate with the female portion of the projecting member. The male portion of the projecting member mates with a portion of the side stake. According to another aspect of the present invention, a portion of the support bracket may be subjected to shot peening.

According to another aspect of the present invention, a method for securing a crossbearer to a side sill and side stake of a railway car is disclosed that includes the steps of forming a support bracket shaped to rest against an interior surface of a vertical and horizontal flange of the side sill; forming a projecting member that is integral to the support bracket and has a male portion and female portion with the projecting member extending into an opening in the side stake; forming an exterior support member that has a base portion and a male portion that sized to mate with the female portion of the projecting member; disposing the base portion of the exterior support member against a portion of the exterior surface of the vertical flange of the side sill; mating the male portion of the projecting member with a portion of the side stake; and finally securing these items in place.

Among the technical advantages of the present invention, the crossbearer connection and method of connecting a crossbearer to the side sill and side stake, allows for a direct connection to the side sill while providing minimal clearance between the side sill or side structure and the rails or prescribed design envelope. Another technical advantage of the present invention, is that it provides for the side sill to pass through the connection without being disrupted. Another technical advantage of the present invention is that it is convenient to install.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

The preferred embodiment of the present invention and its advantages are best understood by referring to FIGS. 1–10 of the drawings, like numerals being used for like and corresponding parts of the various drawings.

Figure 1:
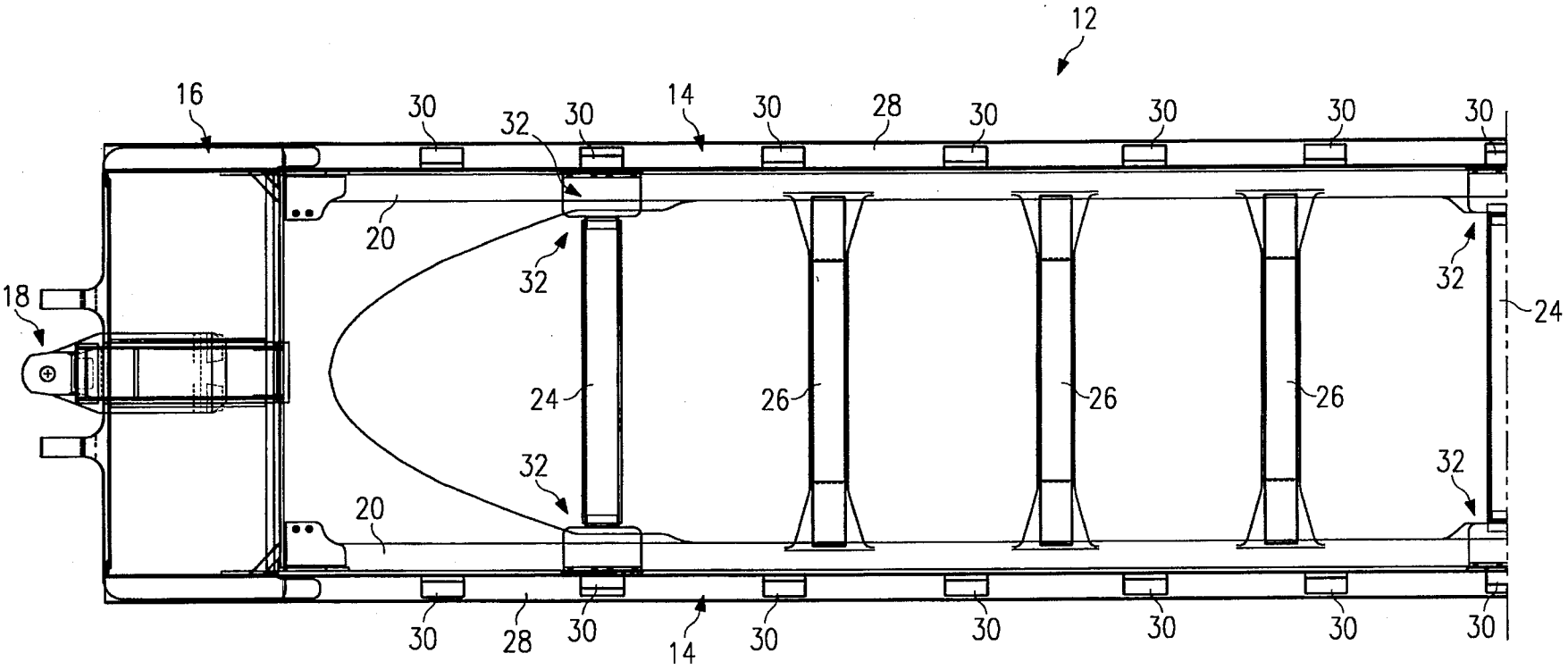
FIG. 1 is a plan view of a railway car according to an aspect of the present invention.

Referring now to FIG. 1, a portion of an underframe of a railway car 12 having side structures 14 and an end structure 16 is shown. End structure 16 includes articulated connection 18 and connections to side sills 20. With the exception of the crossbearer connection and method of connecting a crossbearer to the side sill as described and claimed below, railway car 12 may be any of a number of types with conventional designs, and therefore, aspects other than the crossbearer connection and method are not presented in detail as they are known in the art.

A plurality of crossbearers 24 may be placed transversed to side sills 20 for carrying a floor structure or supporting the lading. A plurality of crossbraces 26 may also extend between side sills 20. Side walls 28 form an exterior of car 12. A plurality of side stakes 30 extend vertically from side sills 20 to provide support and stability for side walls 28. Crossbearer connections 32 are utilized to connect load bearing cross bearers 24 to side sill 20 and corresponding side stakes 30.

Figure 2:
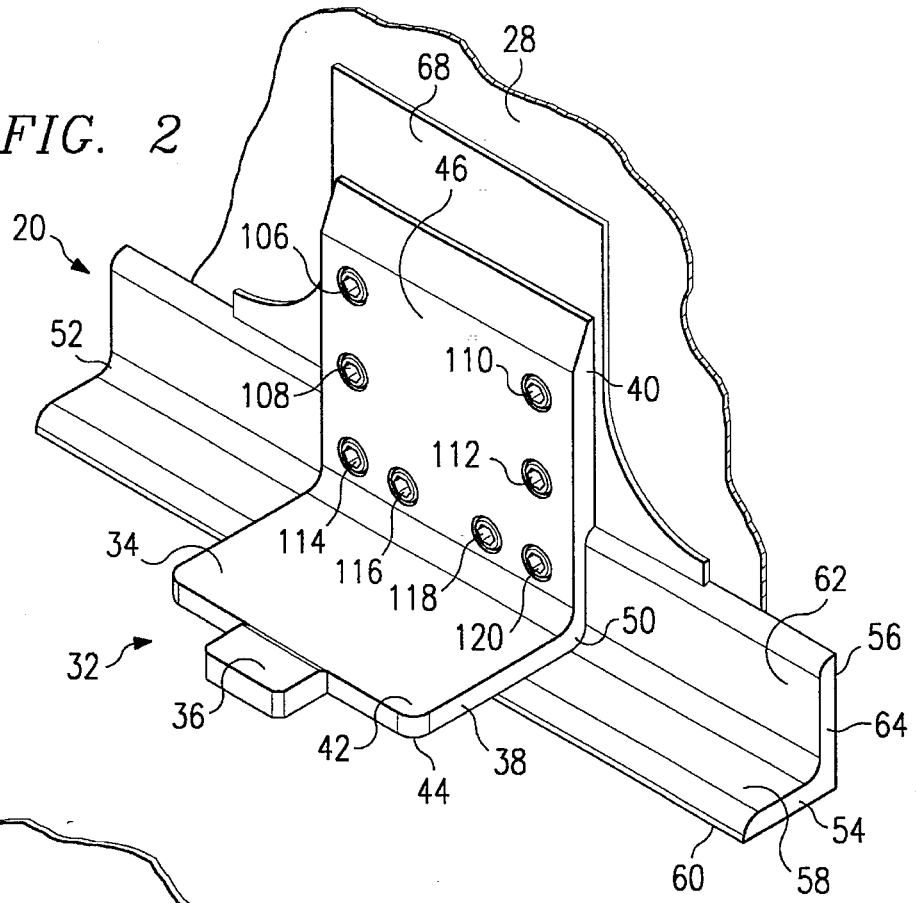
FIG. 2 is a perspective view of a portion of a crossbearer connection according to an aspect of the present invention.

Referring now to FIG. 2, a portion of crossbearer connection 32 that is interior to car 12 is shown. Crossbearer connection 32, which may be one of numerous connections on a given railway car 12, includes a support bracket 34. Support bracket 34 includes an attachment area 36 for securing an end of a crossbearer 24 thereto. Support bracket 34 has a horizontal bracket flange 38 and a vertical bracket flange 40. Horizontal bracket flange 38 has a first surface 42 and a second surface 44 (see FIG. 6). Vertical bracket flange 40 has a first surface 46 and a second surface 48 (see FIG. 4). Horizontal bracket flange 38 is angled with respect to vertical bracket flange 40 such that resultant corner 50 coincides with corner 52 of side sill 20. To enhance support bracket 34, it may be desirable to shot peen corner 50.

Side sill 20 has a side sill horizontal flange 54 and a side sill vertical flange 56. Side sill horizontal flange 54 has a first or interior surface 58 and a second, or exterior surface 60. Side sill vertical flange 56 has a first, or interior, surface 62 and a second, or exterior, surface 64. Corner 52 is formed between flanges 56 and 58. When corner 50 of support bracket 34 is nested or mated with corner 52 of side sill 20, second surface 44 of support bracket 34 rests on first surface 58 of the horizontal flange of side sill 20, and second surface 48 of vertical bracket flange 40 is against or near first or interior surface 62 of side sill vertical flange 56. As shown in FIG. 2, a portion of vertical bracket flange 40 rests against side walls 28, but a reinforcement plate 68 may be placed against side wall 28 between crossbearer connection 32 and side wall 28. A portion of support bracket 34 extends through wall 28 as will be described further below.

Figure 3:
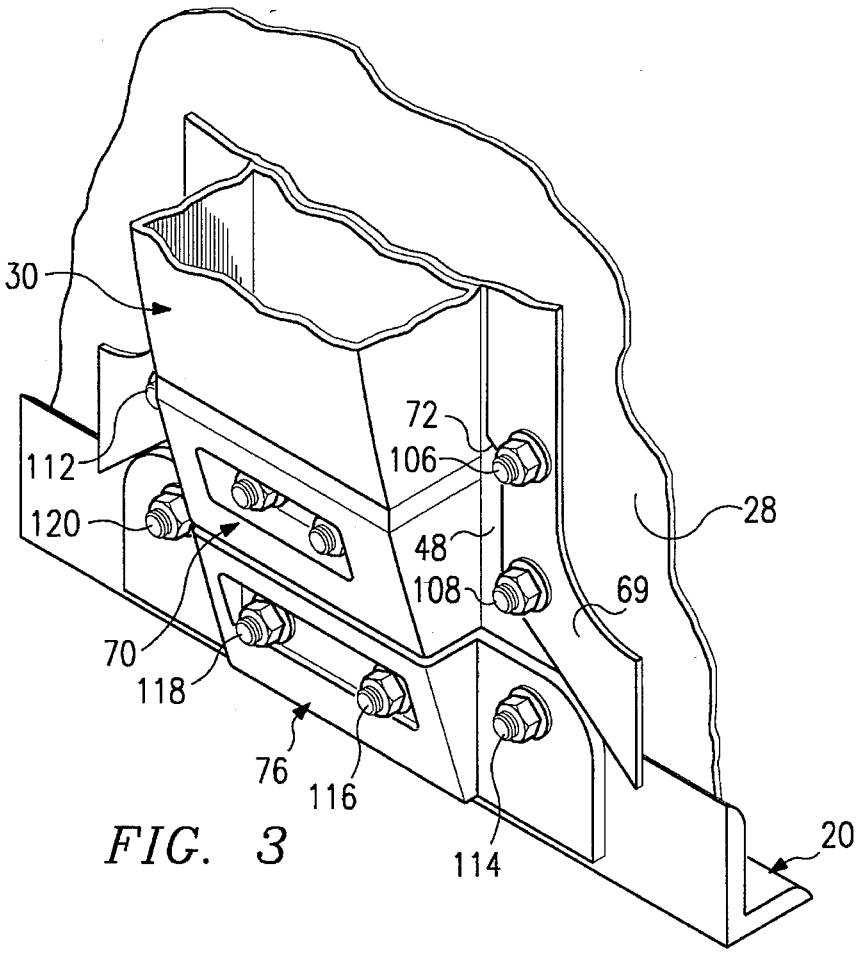
FIG. 3 is a perspective view of a portion of a crossbearer connection according to an aspect of the present invention.

Referring now to FIG. 3, a perspective view from the exterior of the car of a portion of crossbearer connection 32 is shown. From this view, a projecting member 70 of support bracket 34 may be seen. Projecting member 70 projects from second or exterior surface 48 of vertical bracket flange 40. Projecting member 70 may be, and preferably is, an integral part of support bracket 34. Projecting member 70 extends through an opening 72 in side wall 28 and reinforcement plate 69. As will be described in more detail below, projecting member 70 may be associated with exterior support member 76 and side stakes 30.

Figure 4:
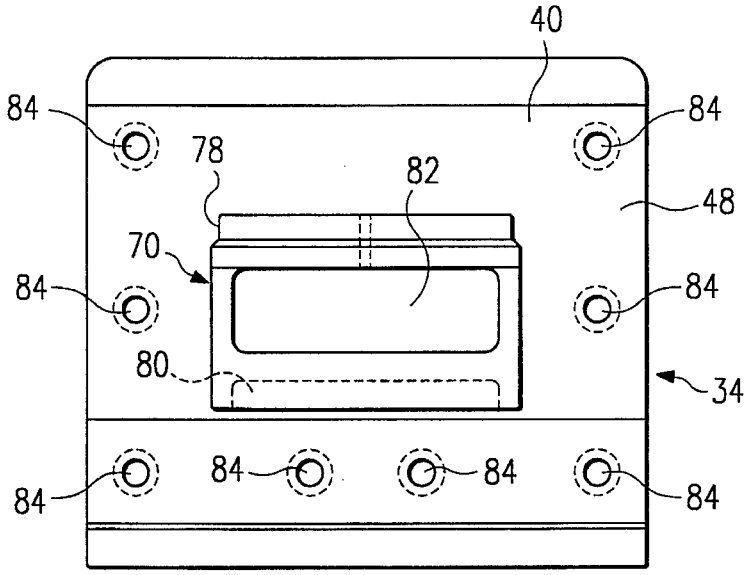
FIG. 4 is a back elevational view of a support bracket according to an aspect of the present invention.
Figure 5:
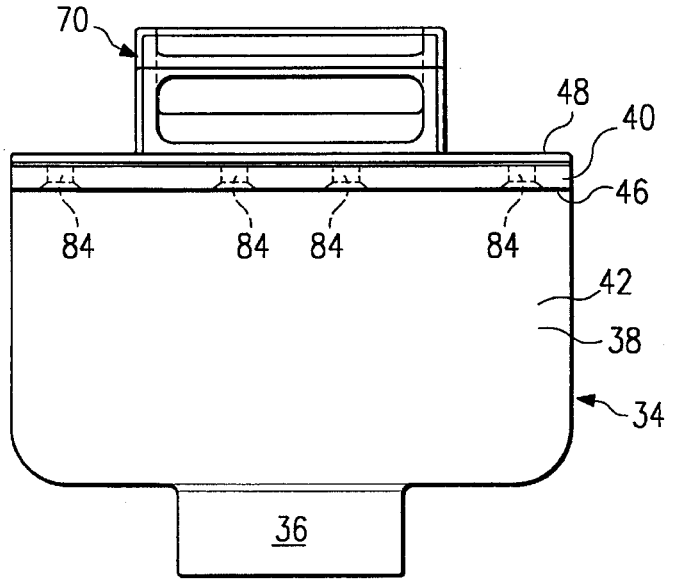
FIG. 5 is a plan view of the support bracket according to an aspect of the present invention.
Figure 6:
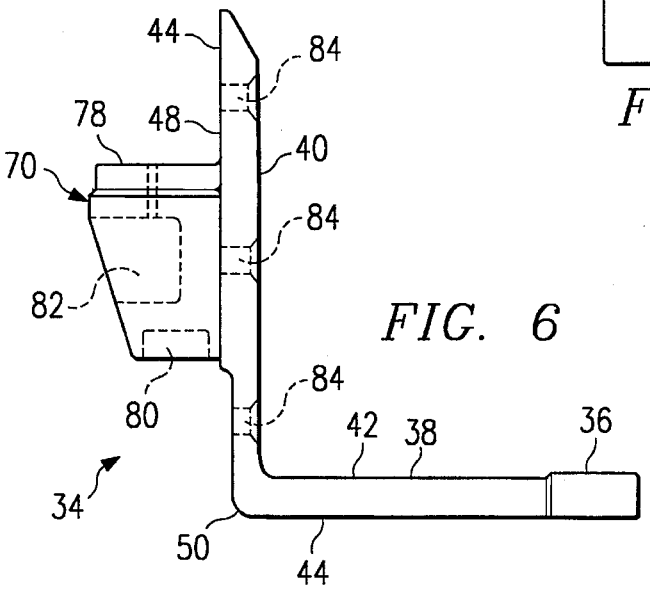
FIG. 6 is a side elevational view of a support bracket according to an aspect of the present invention.

Referring now to FIGS. 4–6, which show a back elevational view, plan view, and a side elevational view respectively of support bracket 34, second or exterior surface 48 of vertical bracket flange 40 of support bracket 34 may be seen and projecting member 70 may be seen to extend from surface 48. Projecting member 70 has a male portion 78 and a receptacle or female portion 80. A hollowed portion 82 may be included. A plurality of holes 84 may be formed in support bracket 34 to accommodate bolts or other fasteners as will be described below. Support bracket 34 is preferably casted, but may be forged or fabricated in other manners.

Figure 7:
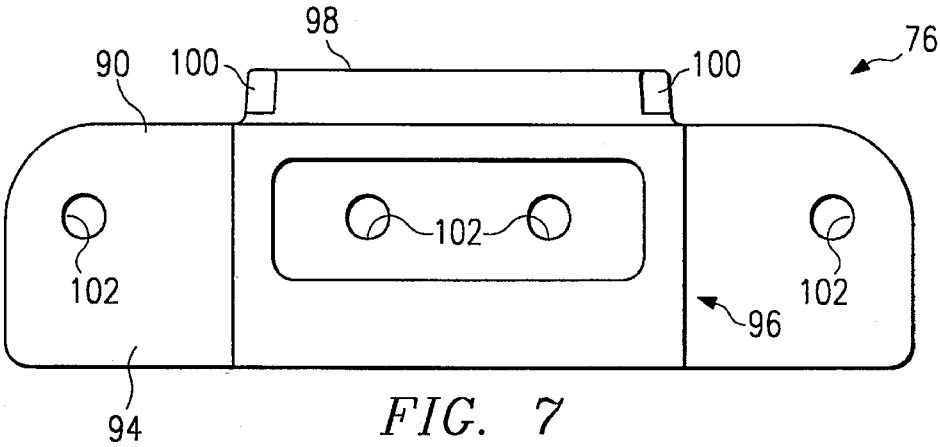
FIG. 7 is an elevational view of an exterior support member according to an aspect of the present invention.
Figure 9:
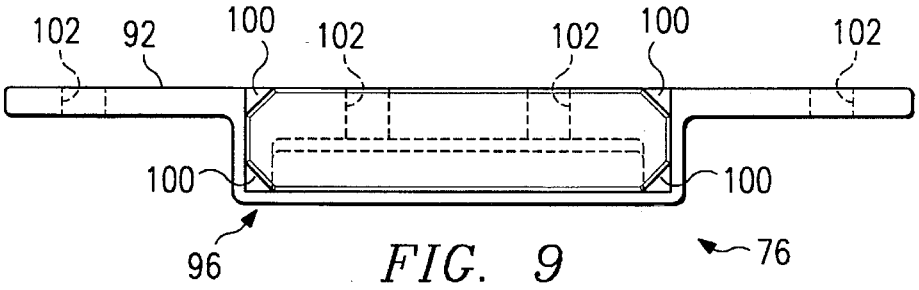
FIG. 9 is a plan view of an exterior support member according to an aspect of the present invention.
Figure 8:
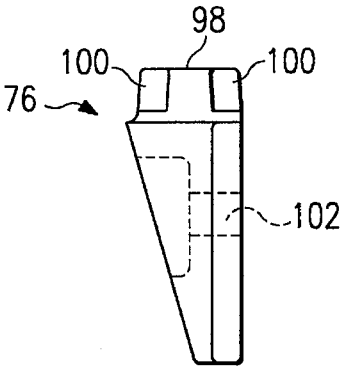
FIG. 8 is a side elevational view of an exterior support member according to an aspect of the present invention.

Referring now to FIGS. 7–9, which show a back elevational view, side elevational view, and a plan view respectively of exterior support member 76, exterior support member 76 has a longitudinal base portion 90 having a first, or interior, surface 92 and a second, or exterior, surface 94. Extending from longitudinal base portion 90 is a protruding member 96 which includes a male portion 98, which may have clipped or rounded corners 100. Male portion 98 is sized to mate with female portion 80 of support bracket 34. A plurality of holes 102 may be formed in exterior support member 76 to accommodate bolts or other fasteners. The vertical width (for the orientation shown in FIG. 7) is such that it substantially coincides with side sill vertical flange 56. Exterior support member 76 is preferably casted although it may also be forged or fabricated using other techniques.

Figure 10:
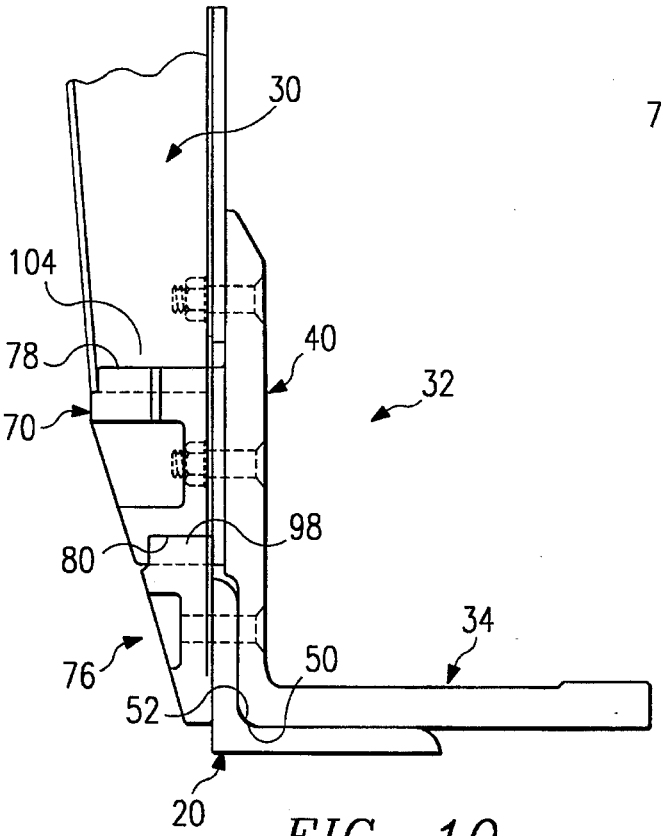
FIG. 10 is a side elevational view with portions broken away of a crossbearer connection according to an aspect of the present invention.

As best shown in FIGS. 2, 3 and 10, the assembly and interconnection of the components previously discussed to form a crossbearer connection 32 may be conveniently accomplished. At the time of forming crossbearer connection 32, side sill 20 and side stake 30 may already be in place. Support bracket 34 may then be placed on side sill 20 such that corner 50 rests on corner 52 of side sill 20 and male portion 78 of projecting member 70 extends into a female portion 104 of side stake 30 as shown in FIG. 10. Fasteners such as bolts 106–112 may then be placed through holes 84 in support bracket 34, and side wall 28. Exterior support member 76 may then be put into place. Male portion 98 of exterior support member 76 is mated with female portion 80 of support bracket 34. Fasteners, such as bolts 114–120 may then be used to secure exterior support member 76 in place.

Once crossbearer connection 32 is passed through opening 72, mated with side stake 30, and exterior support member 76 is mated with support bracket 34, and the necessary fasteners are secured, one embodiment of crossbearer connection 32 is complete. Crossbearer connection 32 allows for direct connection to side stake 30, but also allows support bracket 34 to rest directly on top of side sill 20, which allows side sill 20 to be lower to the railroad tracks than would otherwise be possible. Additionally, crossbearer connection 32 allows side sill 20 to pass through the connection without being disrupted.

Although the present invention and its advantages have been described in detail, it should be understood that various changes, substitutions and alterations can be made therein without departing from the spirit and scope of the invention as defined by the appended claims.

What is claimed is:

1. In a railway car, a crossbearer connection connecting a load-bearing crossbearer to a side sill, the side sill having a vertical flange and a horizontal flange, the railway car having a side stake, and the crossbearer connection comprising:

an L-shaped support bracket having a horizontal bracket flange and a vertical bracket flange, the horizontal bracket flange for placement on the horizontal flange of the side sill and for receiving the crossbearer;

a projecting member attached to the vertical bracket flange; and the projecting member configured for attachment to the side stake after being placed through an aperture in the side wall.

2. The connection as defined in claim 1 further comprising an exterior support member attached to the vertical flange of the side sill opposite the support bracket and attached to the projecting member.

3. The connection as defined in claim 1 further comprising a male portion formed on the projecting member, the male portion of the projecting member mated with the side stake.

4. In a railway car, a crossbearer connection connecting a load-bearing crossbearer a side sill, the side sill having a vertical flange and a horizontal flange, the railway car having a side stake and the crossbearer connection comprising:

a support bracket having a horizontal bracket flange and a vertical bracket flange, the horizontal bracket flange for placement on the horizontal flange of the side sill and for receiving the crossbearer;

a projecting member attached to the vertical bracket flange and extending through an aperture in a side wall of the railway car;

the projecting member attached to the side stake;

an exterior support member attached to the vertical flange of the side sill opposite the support bracket and attached to the projecting member;

a male portion formed on the projecting member;

a female portion formed on a portion of the side stake;

the male portion of the projecting member for mating with the female portion of the side stake;

a female portion formed on the projecting member; and a male portion attached to the exterior support member for mating with the female portion of the projecting member.

5. In a railway car, a load beating crossbearer connection connecting a load bearing crossbearer to a portion of a side sill and to a portion of a side stake, the side sill having a vertical flange and a horizontal flange, the crossbearer connection comprising:

a support bracket angled to rest against an interior surface of the vertical and horizontal flanges of the side sill;

a projecting member formed integral to the support bracket having a male portion and a female portion, and the projecting member extending through an opening in a side wall;

an exterior support member having a base portion and a protruding member with a male portion that is sized to mate with the female portion of the projecting member, the base portion disposed against a portion of an exterior surface of the vertical flange of the side sill;

the male portion of the projecting member mating with a portion of the side stake; and a plurality of fasteners for securing the support bracket to the side sill and the exterior support member to the side sill.

6. The crossbearer connection as defined in claim 5 wherein the support bracket is cast.

7. The crossbearer connection as defined in claim 5 wherein the exterior support member is cast.

8. The crossbearer connection as defined in claim 6 wherein the exterior support member is cast.

9. A method of forming a crossbearer connection for railway cars having side sills, side walls, and side stakes, the method comprising the steps of:

forming a support bracket to nest with an upper surface of the side sill and to receive a crossbearer;

forming a projecting member on one surface of the support bracket;

forming a hole in the side wall of the car proximate the connection and beneath the side stake;

disposing the projecting member through the hole in the side wall and beneath the side stake;

attaching the projecting member to the side stake.

10. The method of claim 9 further comprising the steps of:

forming an exterior support member;

attaching the exterior support member to the side sill; and attaching the exterior support member to the projecting member.

11. The method of claim 9 wherein the step of forming the support bracket comprises:

forming a horizontal bracket flange; and forming a vertical bracket flange.

12. The method of claim 11 further comprising the step of shot peening the support bracket at an intersection of the horizontal bracket flange and the vertical bracket flange.

13. The method of claim 9 further comprising forming a male portion on the projecting member for mating and forming a female portion on the side stake and wherein the step of attaching the projecting member to the side stake comprises mating the male portion of the projecting member with the female portion of the side stake.

14. A method of connecting a load bearing crossbearer to a side sill and a portion of the side sill of a railway car, the side sill having a vertical flange and a horizontal flange, the method comprising the steps of:

forming a support bracket angled to rest against an interior surface of the vertical and horizontal flanges of the side sill and forming the support bracket to have a vertical bracket flange and a horizontal bracket flange;

forming a projecting member attached to the support bracket and extending from the vertical flange of the support bracket;

forming a male portion and a female portion on the projecting member;

forming a hole in a side wall of the car near the connection;

forming a female portion on the side stake with the female portion sized to mate with the male portion of the projecting member;

placing the projecting member through the hole in the side wall;

mating the male portion of the projecting member with the female portion of the side stake;

attaching the support bracket to the side sill and side wall;

forming an exterior support member with a male portion sized to mate wit the female portion of the projecting member;

mating the male portion of the exterior support with the female portion of the projecting member; and securing the exterior support member to a portion of the side sill.

15. The method of claim 14 wherein the step of forming the support bracket further comprising shot peening a portion of the bracket proximate where the vertical bracket flange and horizontal bracket flange meet.

16. The method of claim 14 further comprising the step of placing a reinforcement plate around the hold in the side wall.

17. The method of claim 14 wherein the step of forming a support bracket comprises casting the support bracket.

18. The method of claim 14 wherein the step of forming the exterior support member comprises casting the exterior support member.

19. In a railroad car, a crossbearer connection connecting a crossbearer to a portion of a side sill and a portion of a side stake, the side sill having a horizontal flange and a vertical flange and the crossbearer connection comprising:

a support bracket comprising:

a horizontal bracket flange having a first and second surface, the second surface of the horizontal bracket flange resting against an interior surface of the horizontal flange of the side sill, the first surface of the bracket for receiving the crossbearer, a vertical bracket flange having a first and second surface, the second surface of the vertical bracket flange resting against an interior surface of the vertical flange of the side sill, and a projecting member extending from a portion of the second surface of the vertical bracket flange and having a female portion and a male portion, the projecting member extending through an opening in the side stake and the male portion of the projecting member mating with a female portion of the side stake;

an exterior support member comprising:

a longitudinal base portion having a first and second surface, the first surface resting against an exterior surface of the vertical flange of the side sill, and a protruding member having a male portion extending from the longitudinal base portion and mating with the female portion of the projecting member of the support bracket;

and a plurality of fasteners for securing the longitudinal base portion of the exterior support and the support bracket to the side sill and to each other.

20. The crossbearer connection as defined in claim 19 wherein the male portion of the projecting member is formed with rounded corners.

* * * * *